United States Patent [19]

Moriya et al.

[11] Patent Number: 4,647,237

[45] Date of Patent: Mar. 3, 1987

[54] DOT MATRIX PRINT HEAD

[75] Inventors: Mikio Moriya; Teruo Kinoshita, both of Tanashi, Japan

[73] Assignee: Citizen Watch Co., Ltd., Tokyo, Japan

[21] Appl. No.: 753,040

[22] Filed: Jul. 9, 1985

[30] Foreign Application Priority Data

Jul. 9, 1984 [JP] Japan ..... 59-103624[U]

[51] Int. Cl.[4] ..... B41J 3/12

[52] U.S. Cl. ..... 400/124; 101/93.05; 335/274; 335/276

[58] Field of Search ..... 400/124; 101/93.05; 335/274–276

[56] References Cited

U.S. PATENT DOCUMENTS

| | | | |
|---|---|---|---|
| 4,244,658 | 1/1981 | Mori | 400/124 |
| 4,335,969 | 6/1982 | Ott | 400/124 |
| 4,375,338 | 3/1983 | Mitsuishi | 400/124 |
| 4,537,520 | 8/1985 | Ochiai | 400/124 |
| 4,547,085 | 10/1985 | Ochiai | 400/124 |

*Primary Examiner*—Paul T. Sewell

*Attorney, Agent, or Firm*—Birch, Stewart, Kolasch & Birch

[57] ABSTRACT

A dot matrix print head comprises a print wire unit in which a plurality of print wires are slidably mounted, an electromagnet unit having a plurality of electromagnets, and an armature unit secured to the print wire unit and to the electromagnet unit. The armature unit has a cover, a plurality of springs and a plurality of armatures. The armatures are held in the cover by a sub yoke secured to the cover.

2 Claims, 3 Drawing Figures

DOT MATRIX PRINT HEAD

BACKGROUND OF THE INVENTION

The present invention relates to a print head for a dot matrix printer of the type in which a plurality of print wires are selectively driven through armatures by electromagnets to perform printing.

A print head of the above described type is disclosed in U.S. Pat. No. 4,204,778. In a print head, a plurality of armatures (clappers) are securely mounted on a leaf spring and a projecting iron plunger is provided on each armature so as to be attracted to a core of an electromagnet. The plunger is projected through an opening of a yoke plate to the core. Therefore, as assembled, the yoke plate is mounted on the electromagnet unit and the leaf spring with armatures is secured to a cover (stopper plate) by a washer. Then the armatures secured to the leaf spring are disposed on the yoke plate such that each of the plungers is inserted into the respective opening of the yoke plate, and then the cover is secured to a print wire guide body (nose) by a screw.

Consequently, a large number of processes is required to assemble such a complex structure, and workability for the assembly is very low. Further, if the plunger is not accurately positioned on the armature, the plunger is not properly located in the opening of the yoke plate, and may come in contact with the wall of the opening. Accordingly, high accuracy in the manufacturing of components is required.

SUMMARY OF THE INVENTION

The object of the present invention is to provide a dot matrix print head wherein the number of the processes for assembling the head is reduced while increasing the workability of the assembly.

In accordance with the present invention, a print wire unit, electromagnet unit and armature unit are independently manufactured respectively, and armatures do not remove from the unit. Accordingly, these units are manufactured at the same time on respective assembling lines and the units are assembled to a complete print head.

In an aspect of the present invention, a bent end portion of each armature has a smaller width than a notch, and the armature has a pair of shoulders at both sides of the bent end portion, the lower edge of each shoulder being engaged with the surface of a sub yoke, whereby the armature is rotated about the lower edges as a fulcrum.

These and other objects and features of the present invention will become more apparent from the following description with reference to the accompanying drawings.

DESCRIPTION OF THE PREFERRED EMBODIMENT

Figure 1:
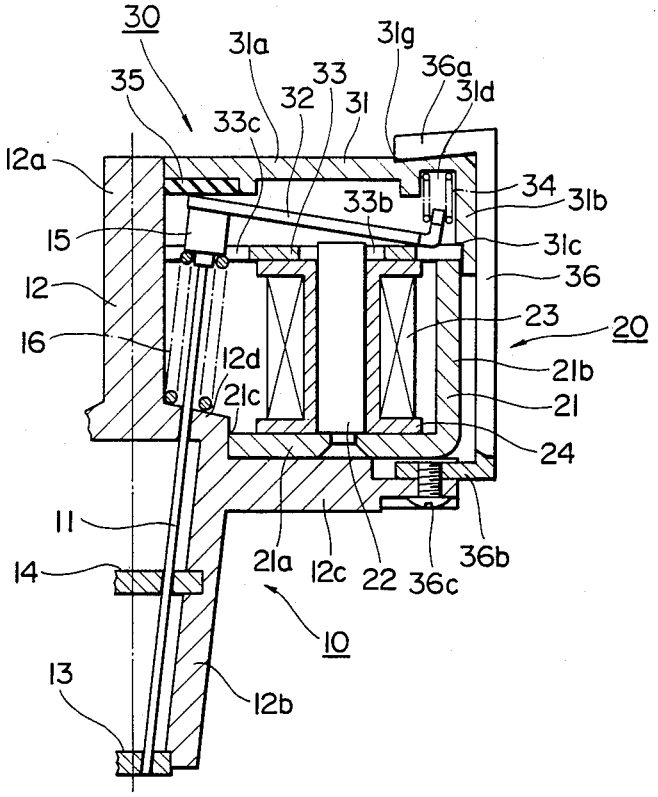
FIG. 1 is a sectional view showing a print head for a dot matrix printer according to the present invention.
Figure 2:
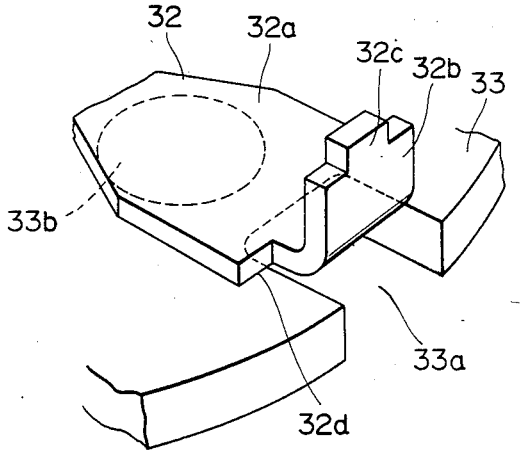
FIG. 2 is an enlarged perspective view showing a part of an armature and sub yoke plate.
Figure 3:
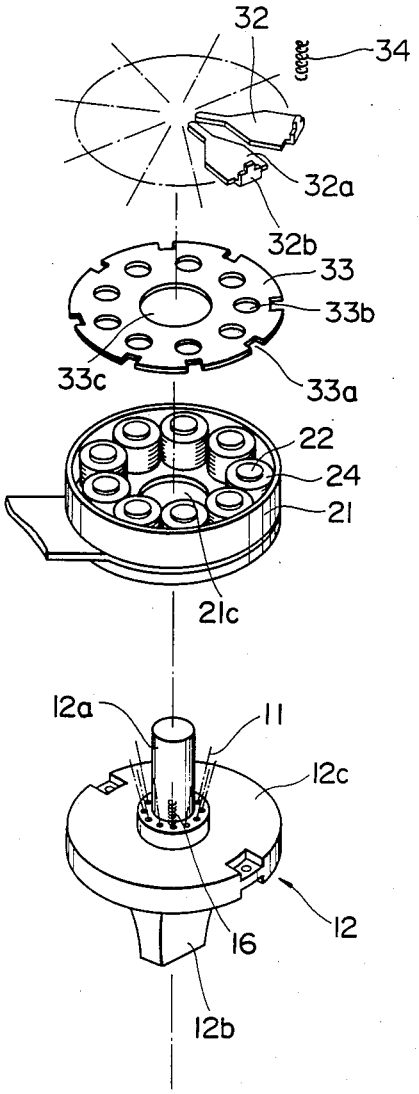
FIG. 3 is an exploded perspective view schematically showing components of the print head.

Referring to FIGS. 1 to 3, a print head according to the present invention comprises a print wire unit 10, an electromagnet unit 20 secured to the print wire unit 10, and an armature unit 30 mounted on the electromagnet unit 20.

The print wire unit 10 comprises a print wire guide body 12 and a plurality of print wires 11 disposed in the body 12. The wire guide body 12 has a post 12*a*, a hollow wire guide nose 12*b* extending from the post 12*a*, and a circular flange 12*c* horizontally provided on the wire guide nose 12*b*. A shoulder 12*d* formed at a portion between the post 12*a* and the guide nose 12*b* has a plurality of holes for slidably guiding print wires 11. The wire guide nose 12*b* is provided with an end guide plate 13 and an intermediate guide plate 14, both of which are secured to the inside wall thereof for slidably guiding print wires. Each of the print wires 11 is slidably supported on the shoulder 12*d*, intermediate guide plate 14 and end guide plate 13. Print wires 11 are circularly disposed in a rear portion of the print head, surrounding the post 12*a*, and arranged on the straight in the end guide plate 13, at the front end of the nose 12*b*. Each of print wires 11 has an impact head 15 secured to the tip end thereof and a compression spring 16 disposed between the impact head 15 and shoulder 12*d*. Thus, when the print wire 11 is mounted on the wire guide body 12, the print wire 11 is biased to the rear portion of the print head.

The electromagnet unit 20 comprises a cylindrical main yoke 21 having a central opening 21*c* for receiving the print wire unit 10 and a plurality of cores 22 circularly disposed and secured to a base plate 21*a*. A coil bobbin 24 having a coil 23 is attached to the core 22 so that an electromagnet is formed. The core 22 is formed such that the top end thereof is projected from the coil bobbin 24 and slightly projected from an annular sub yoke plate 33 which will be hereinafter described.

The armature unit 30 comprises a cylindrical cover 31 to be engaged with the main yoke 21, a plurality of armatures 32 for impacting the print wires 11 by attracting force of the electromagnet, and sub yoke plate 33 disposed between the armature 32 and coil bobbin 24. A pair of clamps 36, each having a U-shaped section comprising an upper hook portion 36*a* and a lower hook portion 36*b* with a female thread, are provided for firmly securing the print head. The cover 31 has a central hole for receiving the wire guide body 12, and small hollows 31*d* formed on the periphery of the inside of a base plate 31*a*, each corresponding to core 22 for receiving an armature loading spring 34. Further, the cover 31 has an annular shoulder 31*c* formed on the inner edge of a cylindrical side frame 31*b* for receiving the sub yoke 33. The armature 32 comprises an operating body portion 32*a*, and bent end portion 32*b* formed on an outer end portion of the operating portion 32*a*. The bent end portion has a smaller width than the operating body portion 32*a* and an engaging portion 32*c* formed on the end thereof to be engaged with an armature loading spring 34. The sub yoke plate 33 is formed with a plurality of notches 33*a* at the periphery thereof corresponding to the bent end portion 32*b* of the armature 32. As shown in FIG. 2, the notch 33*a* has a larger width than the bent end portion 32*b*, and shoulders 32*d* of the armature 32 formed between the operating body portion 32*a* and bent end portion 32*b* are positioned on the sub yoke at both sides. Accordingly, a lower portion of the bent portion 32*b* engages with the notch 33*a*, so that the armature 32 can be pivotally rotated about the lower edge of each shoulder 32*d* as a fulcrum. Further, the sub yoke 33 has a plurality of apertures 33*b* corresponding to the cores 22 to permit the top end of the core 22 to project therefrom, and a central opening 33*c* for print wires 11.

Thus, when one of electromagnets is energized, armature 32 is attracted, rotating about the lower edge of the shoulder 32*d*, to push the wire to a platen (not shown) against springs 16 and 34, to print a dot.

In assembling, respective units 10, 20 and 30 are previously assembled. That is, the impact head 15 is secured to each print wire 11 and the spring 16 is engaged with the wire. Then the print wires 11 are inserted into holes at the shoulder 12*d*, intermediate guide plate 14 and end guide plate 13. Thus, the print wire unit 10 is assembled. The electromagnet unit 20 is assembled in such a way that coil bobbins 24 having coils 23 are secured to the cores 22 secured to the main yoke 21 while the cover 31 is turned upside-down, and each armature loading spring 34 is inserted into the housing 31*d*. Then, the engaging portion 32*c* of the armature 32 is engaged with the projected end of the spring 34. A bumper cushion 35 made of rubber is disposed between the base plate 31*a* and the inner end of the armature 32. The sub yoke 33 is mounted on the armature 32 such that the lower portion of the bent end portion 32*b* is inserted into the notch 33*a* and the peripheral edge is force fitted with shoulder 31*c* of the cover 31. Thus, the armature unit 30 is independently assembled.

In order to assemble the print head, the opening 21*c* of the main yoke 21 is engaged with the guide nose 12*b* of the guide body 12 and the base plate 21*a* is mounted on the flange 12*c*. Thus, the base plate 21*a* is force fit to the guide body 12 at the hole 21*c* or secured to the flange 12*c* by screws (not shown). Then, the armature unit 30 is mounted on the electromagnet unit 20, in such a manner that the side frame 31*b* of the cover 31 is engaged with an upstanding plate 21*b* of the yoke 21, and the sub yoke 33 is mounted on bobbins 24 so as to dispose each aperture 33*b* of the sub yoke 33 in coaxial relation with the corresponding core 22. Finally, the upper hook portion 36*a* of each clamp 36 is engaged with an engaging portion 31*g* formed on the base plate 31*a* and the lower hook portion 36*b* is secured to an engaging portion formed on the flange 12*c* by a screw 36*c*.

From foregoing, it will be understood that the present invention provides a print head comprising an independent armature unit, an electromagnet unit and a print wire unit, and hence the armature unit can be easily mounted on the electromagnet unit without other parts or tools for assembly process. Accordingly, the assembly can be done for a short time.

While the invention has been described in conjunction with preferred specific embodiments thereof, it will be understood that this description is intended to illustrate and not limit the scope of the invention, which is defined by the following claims.

What is claimed is:

1. A dot matrix print head comprising:

a print wire unit including a print wire guide body and a plurality of print wires, each of which is axially slidably mounted in the print wire guide body;

an electromagnet unit including a cylindrical main yoke having a base plate, a plurality of cores circularly disposed about a center of said cylindrical main yoke and secured to said base plate, and a coil provided on each core;

an armature unit including, a cylindrical cover having a peripheral side frame and a plurality of hollows formed inside said side frame, a plurality of armatures corresponding to said cores respectively, each armature having an inner end portion adjacent to a base end of each print wire, an operating body portion, and a bent end portion which is bent towards said cover and has a smaller width than the body portion, a spring provided between the hollow and the bent end portion, and an annular sub yoke secured to said side frame so that a base portion of each armature is urged to said sub yoke, said sub yoke having a plurality of openings each corresponding to a core; and clamping means engaging with said print wire unit and said armature unit at peripheral portions of the units and holding said print wire unit, electromagnet unit and armature unit, said electromagnet unit being disposed between said armature unit and said print wire unit.

2. The dot matrix print head according to claim 1, wherein the annular sub yoke has a plurality of notches formed at the periphery thereof, each corresponding to the bent end portion of the armature and having a larger width than the bent end portion and the armature has a pair of shoulders at both sides of the bent end portion, the lower edge of each shoulder being engaged with the surface of the sub yoke, whereby the armature is rotated about the lower edges as a fulcrum.

* * * * *